United States Patent [19]

Kolton et al.

[11] Patent Number: 4,718,546

[45] Date of Patent: Jan. 12, 1988

[54] DISPLAY HANGER FOR SUSPENDERS

[75] Inventors: Chester Kolton, Westfield; Stuart S. Spater, Livingston, both of N.J.

[73] Assignee: B7G Plastics, Inc., New York, N.Y.

[21] Appl. No.: 882,487

[22] Filed: Jul. 7, 1986

[51] Int. Cl.[4] ..... A47G 25/14; A47G 25/36

[52] U.S. Cl. ..... 206/296; 206/278; 223/85; 223/87; 211/113; 40/322; D6/315

[58] Field of Search ..... 223/DIG. 1, 85, 87, 223/92, 95; 2/340; D6/315, 327; 211/113; 40/322; 248/339; 206/278, 288, 295, 296, 478, 481, 482, 493

[56] References Cited

U.S. PATENT DOCUMENTS

| | | | |
|---|---|---|---|
| D. 35,247 | 10/1901 | Jacobs | 211/113 X |
| D. 193,318 | 7/1962 | Kelley | D6/315 |
| 376,997 | 1/1888 | Voorhis | 206/278 |
| 402,885 | 5/1889 | Babcock | 211/113 |
| 405,257 | 6/1889 | Harris | 211/113 |
| 793,045 | 6/1905 | Bronson | 206/482 X |
| 893,666 | 7/1908 | Silvermann | 206/278 X |
| 1,808,303 | 6/1931 | Freiler | 206/278 |
| 3,136,419 | 6/1964 | Ruderian | 206/493 X |
| 3,310,272 | 3/1967 | Brunger | D6/315 X |
| 3,692,269 | 9/1972 | Hales | 223/85 X |
| 3,710,996 | 1/1973 | Smilow et al. | 223/87 |
| 3,945,500 | 3/1976 | Meckstroth | 223/DIG. 1 X |
| 4,118,804 | 10/1978 | Freese | 2/340 |

FOREIGN PATENT DOCUMENTS

| | | | |
|---|---|---|---|
| 809831 | 12/1936 | France | 211/113 |

*Primary Examiner*—Robert R. Mackey

*Attorney, Agent, or Firm*—Robin, Blecker & Daley

[57] ABSTRACT

Display apparatus is provided for an article having a slotted extremity of given maximum open dimensions in length and width. The apparatus comprises a flat upstanding body having an opening extending therethrough. An elongate member is cantilever-supported in upstanding first disposition in the plane of the body in the opening, such cantilever-supported member having a shank portion contiguous with the body and having an enlargement at the free end thereof. The enlargement has a width exceeding the width of the shank portion, less than such article maximum slot length and greater than such article maximum slot width. The member is deflectable out of the plane of the body into second disposition sufficiently for entry of the enlargement into the article slot for releasably retentive joinder with the article extremity.

3 Claims, 14 Drawing Figures

DISPLAY HANGER FOR SUSPENDERS

FIELD OF THE INVENTION

This invention relates generally to display hangers and pertains more particularly to a hanger for releasably retaining suspenders for trousers, or skirts, for display of the suspenders and of related marketing information.

BACKGROUND OF THE INVENTION

In the case of belts for trousers and skirts, it was, for many years, customary to package the belt in overlayered manner in a box-like structure having a viewing window showing the belt buckle and an adjacent limited portion of the belt. The belt was not seen in its entirety and, of course, could not be examined in full by the consumer without opening the box and removing same. Such marketing disadvantage for belts was alieviated in great measure by developments of the assignee hereof evidenced in the belt hangers of U.S. Pat. Nos. 3,710,996 and No. 4,063,669, each of which provided for hanging display of belts and for customer full examination thereof with the hanger securely attached to the buckle end of the belt and for ready rehanging thereof following examination.

Suspender marketing, as heretofore known, has been effected by box-like containing structures, providing only partial viewing of the product by the consumer or by hangers not securely attached to a suspender end. The marketing disadvantage has been akin to that of belts existing prior to the developments set forth in the above noted commonly-assigned patents.

SUMMARY OF THE INVENTION

The present invention has as its primary object to provide apparatus for effecting full display of suspenders at the point of purchase without need for removal thereof from containers.

A more particular object of the invention is the provision of a simple and effective suspender hanger which is releasably but securely attached to an extremity of the suspenders to fully display same.

In attaining the foregoing and other objects, the invention provides display apparatus for an article having a slotted extremity of given maximum open dimensions in length and width. The apparatus comprises a flat upstanding body having an opening extending therethrough. An elongate member is cantilever-supported in upstanding first disposition in the plane of the body in the opening, such cantilever-supported member having a shank portion contiguous with the body and having an enlargment at the free end thereof. The enlargement has a width exceeding the width of the shank portion, less than such article maximum slot length and greater than such article maximum slot width. The member is deflectable out of the plane of the body into second disposition sufficiently for entry of the enlargment into the article slot for releasably retentive joinder with the article extremity.

Suspenders displayed by the hanger of the invention include two elongate strap members of elastic material, adapted respectively to traverse the shoulders of a wearer. At free ends of the strap members, each supports a pair of stems slotted to engage and retain buttons located on the interior of the trousers waistband.

In accordance with the invention, the display hanger cantilever supported members have characteristics compatible with such stem slots and further with the thickness of the suspender stems.

The foregoing and other objects and features of the invention will be further understood from the following detailed description of a preferred embodiment thereof and from the drawings wherein like refererence numerals identify like parts and components throughout.

DESCRIPTION OF THE PREFERRED EMBODIMENT

Figures 1, 2, 3:
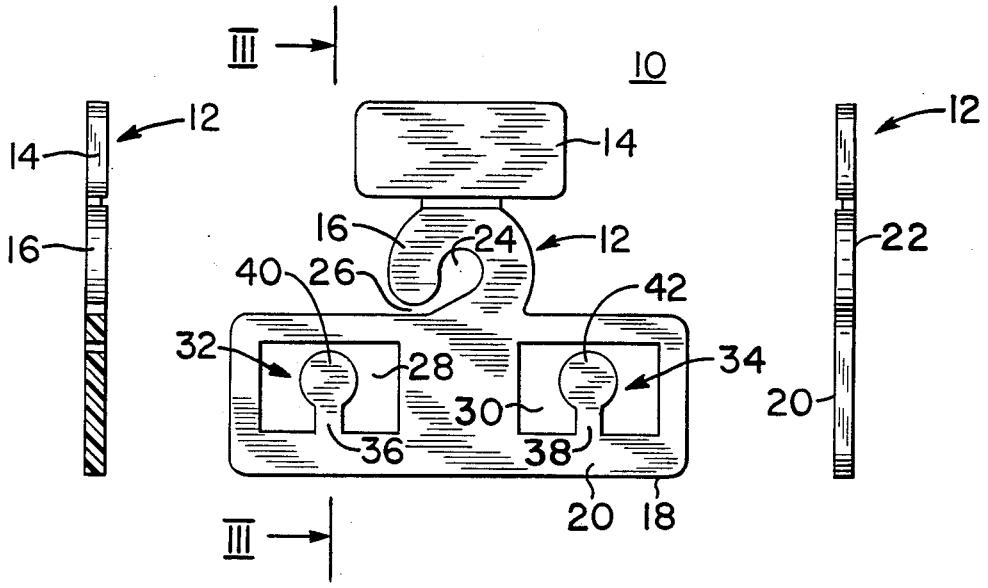
FIG. 1 is a front elevational view of a display hanger in accordance with the invention.
FIG. 2 is a right side elevational view of the FIG. 1 hanger.
FIG. 3 is a sectional view of the FIG. 1 hanger, as would be seen from plane III—III of FIG. 1.

Referring to FIGS. 1–3, hanger 10 has a molded plastic body 12 having an upper marketing information display portion 14, an intermediate hook portion 16 and a lower article engaging portion 18. Body 12 has a planar or flat front surface 20 and a planar or flat rear surface 22, thereby defining body 12 as planar.

Hook portion 16 has a central opening 24 and access passage 26 for receiving a display rod, numerous such hangers 10 thus being commonly rod-supported.

Lower portion 18 has first and second generally rectangular openings 28 and 30 extending therethrough and includes elongate members 32 and 34 extending into the openings, these members being cantilever-supported at lower ends thereof by lower portion 18 and disposed in FIGS. 1–3 in first disposition in the plane of body 12.

Members 32 and 34 have respective shanks 36 and 38, contiguous with lower portion 18, and respective enlargements 40 and 42 at their free ends.

Figures 4, 5:
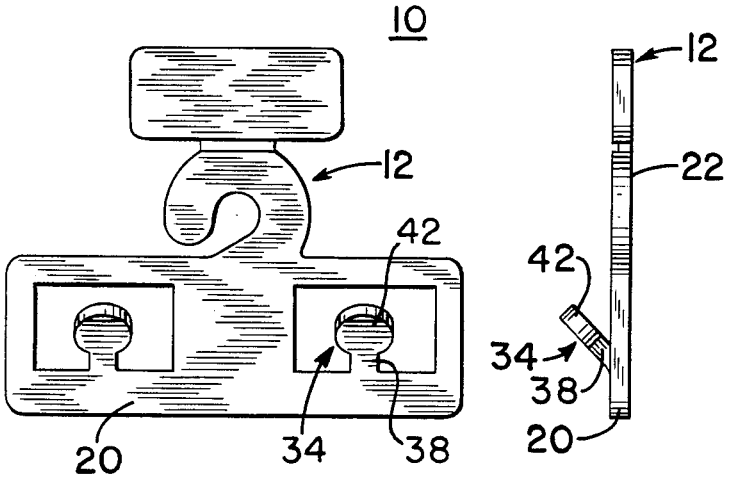
FIG. 4 is a further front elevational view of the FIG. 1 hanger, with its suspender engaging members deflected into suspender receiving disposition.
FIG. 5 is a right side elevational view of FIG. 4.

By applying finger pressure on members 32 and 34 rearwardly through openings 28 and 30, one can deflect the members into second dispositions shown in FIGS. 4 and 5. On this event, members 32 and 34 each are outward of the plane of body 12 and in disposition for receiving articles to be hung, specifically, suspenders of type partly shown in FIG. 14 to have straps 44 and 46. Considering strap 46, it includes an end 48 having a passage therein for supporting loopable link 50 which has stems 52 and 54. Stem 52 will be seen to have slot 56 therethrough, terminating in a circular opening 58. In customary wearing of the suspenders, buttons on the interior of the waistband of trousers are inserted into and through slot 56 such that the button stitching thread resides in opening 58 and the button lies flat with stem 52 and retains the stem and button assembly.

Figure 6:
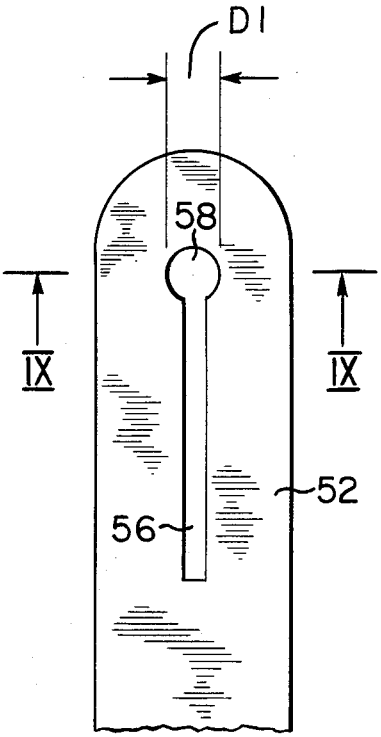
FIG. 6 is an enlarged plan view of an end portion of a suspender waistband button engaging stem.
Figure 9:
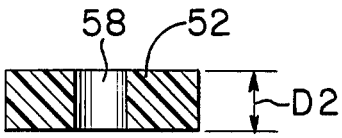
FIG. 9 is a sectional view at plane IX—IX of FIG. 8.

Stem 52 is shown in enlarged partial end part in FIG. 6 and in section in FIG. 9. The diameter of opening 58 is indicated as D1 and the thickness of stem 52 is indicated as D2. Maximum slot open dimension in width is D1, and maximum slot open dimension in length is the sum of D1 and the length of slot 56.

Figure 7:
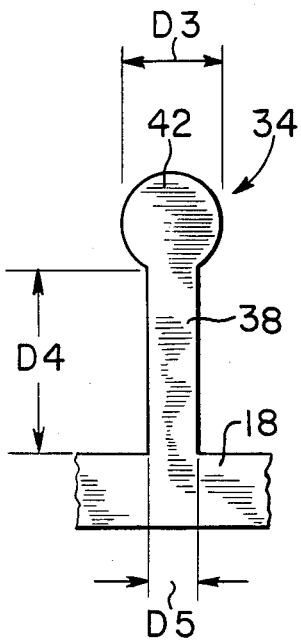
FIG. 7 is an enlarged partial view of a suspender engaging member of the FIG. 1 hanger.
Figure 8:
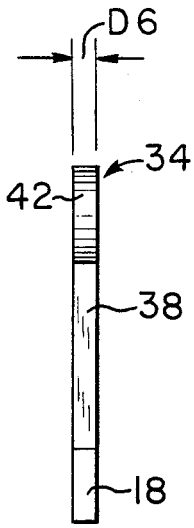
FIG. 8 is a right side elevational view of FIG. 7.

In FIGS. 7 and 8, hanger cantilever-supported member 34 is shown to have its enlargement 42 of diameter D3, its shank 38 of length D4 and width D5, and a common thickness D6 throughout. For intended use purposes, discussed immediately below, measures D1 through D6 have identifiable interrelationships.

Figure 10:
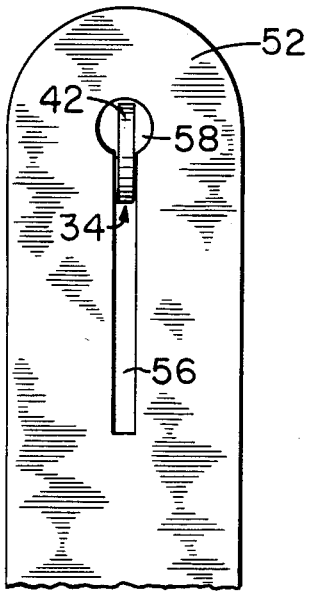
FIGS. 10 and 11 illustrate the initial step in engaging a hanger suspender engaging member with a suspender stem.
Figure 11:
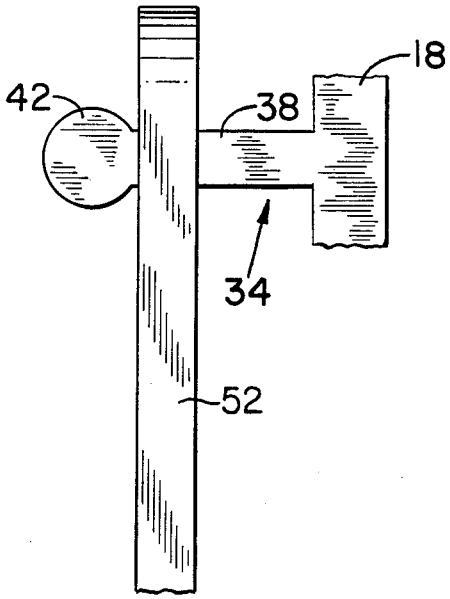
Figure 14:
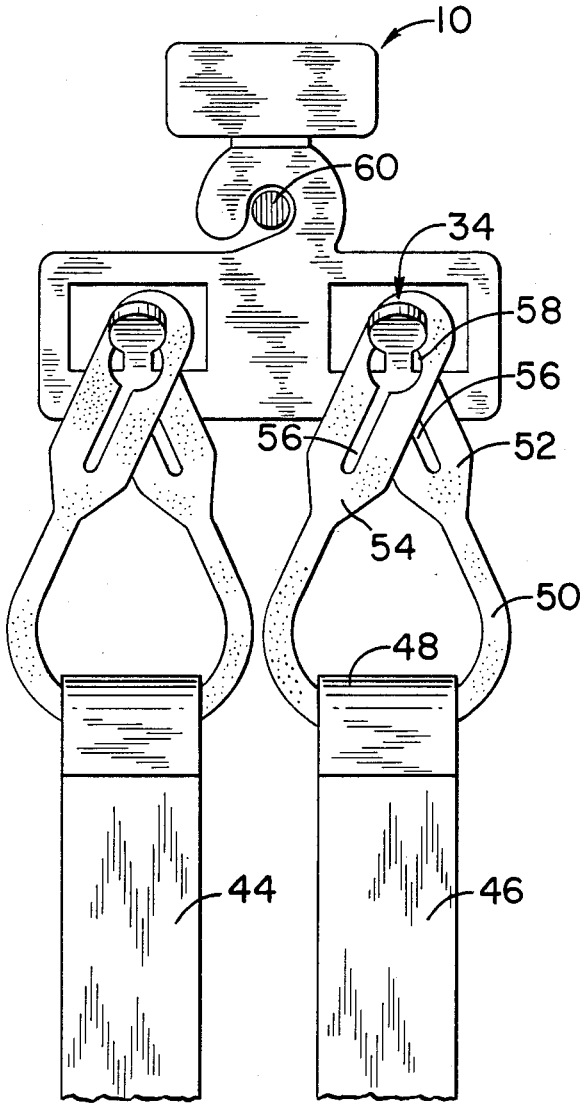
FIG. 14 shows the hanger of FIG. 1 with suspenders thereby displayed.

In reaching the final assembly of hanger 10 and the suspenders of FIG. 14, an initial step is practiced, as is shown in FIGS. 10 and 11. Here, enlargement 42 of member 34 and slot 56 of stem 52 are mutually aligned, with member 34 in its deflected (FIGS. 4 and 5) disposition. Stem 52 is now forced onto shank 38, past enlargement 42. This is enabled by D3 being less than the sum of D1 and the length of slot 56.

Figure 12:
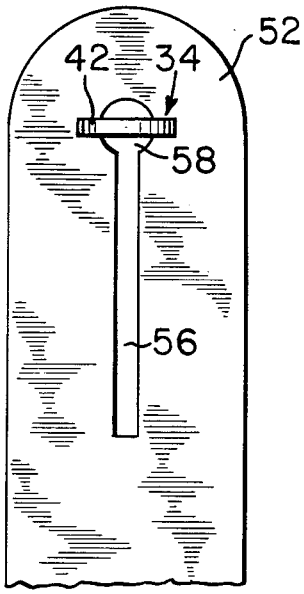
FIGS. 12 and 13 illustrate a second step in engaging a hanger suspender engaging member with a suspender stem.
Figure 13:
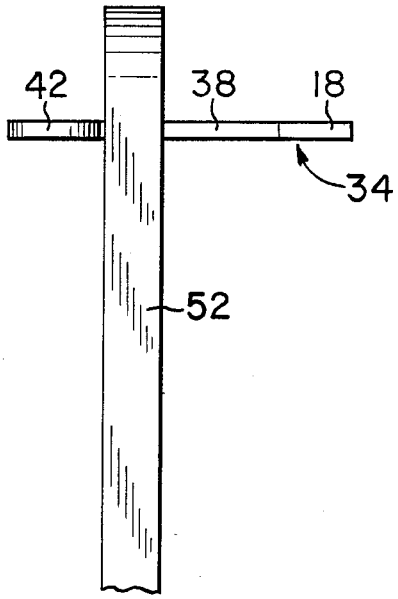

The second step is seen in FIGS. 12 and 13. Stem 52 is rotated, while on shank 38 as in FIGS. 10 and 11, ninety-degrees into its FIGS. 12 and 13 orientation. This is enabled since shank width D5 and thickness D6 are less than opening 58 diameter Dl. On this event, enlargement 42 extends in outer part beyond opening 58 into interfering relation with stem 52 surface bounding opening 58, since D3 exceeds D1. This completes the retention of stem 52 by member 42. The steps are practiced each in reverse manner if it is desired to release the retained stem.

Turning again to FIG. 14, the next hanger and suspender assembly step is that of applying stem 54 to member 34, which is done by repeating the steps of FIGS. 10–13. For this practice, D4 need be at least twice D2 (FIGS. 7 and 9) such that both stems may reside on shank 38 beneath enlargement 42. With stems 52 and 54 secured to member 34, member 34 is returned to its non-deflected FIGS. 1–3 first disposition, wherein it is again in the plane of body 12. Clearance between the top of member 34 and the top of the opening of lower portion 18 is made less than stem thickness D2 to mitigate against stem 54 working its way free of the assembly.

The stems of suspender strap 44 are likewise applied to member 32, as shown in FIG. 14 and the hanger applied to rod 60, as shown, for suspender display.

By way of summary and introduction to the ensuing claims, the invention will be seen to provide a display hanger for suspenders having a slotted trouser button-receiving stem for wearing thereof, comprising a flat body, the hanger including a hook portion, and a lower portion including an elongate cantilever-supported member having a shank portion contiguous with the body and having an enlargement at the free end thereof. The shank portion and the enlargement are compatibly configured with the stem slot for releasable retentive joinder with the stem.

More particularly, the invention provides a display hanger for suspenders of type including a pair of straps, each strap having a pair of slotted stems at an extremity thereof, each such slot being of given maximum open dimensions in length and width. The hanger comprises a flat upstanding body having a pair of openings extending therethrough, an elongate member cantilever-supported in upstanding first disposition in the plane of said body in each such opening. Each such member has a shank portion contiguous with the body and has an enlargement at the free end thereof. Each enlargement has a width exceeding the width of the shank portion, less than such maximum slot length and greater than such maximum slot width. Each such member is deflectable out of the plane of the body into second disposition sufficiently for entry of the enlargement into the slots for releasably retentive joinder with a pair of the stems. Further each stem is of given thickness and upward clearance between each member and the body with the member in such first disposition is of measure less than said stem thickness. Lastly, each shank portion has a length at least equal to twice such stem thickness.

Various changes may be introduced in the foregoing detailed embodiment of the invention without departing from the invention. Thus, the particularly depicted and discussed embodiment is intended in an illustrative and not in a limiting sense. The true spirit and scope of the invention is set forth in the following claims.

We claim:

1. In combination, suspenders of type including a pair of straps, each strap having a pair of slotted stems at an extremity thereof, each such slot being of given maximum open dimensions in length and width, and a display hanger comprising a flat upstanding body having a hook portion and having a pair of openings extending therethrough below said hook portion, and an elongate member cantilever supported in upstanding disposition in said body in each said opening, each said member having a shank portion contiguous with said body and having sufficient length for residence in the slots of a distinct pair of stems, and having an enlargement at the free end thereof for retention of said stems, said enlargement having a width exceeding the width of said shank portion, less than such maximum slot length and greater than such maximum slot width, said openings and said members further being of respective dimensions such that said members may be deflected from first dispostions in the plane of said body into second dispositions out of the plane of said body to receive said stems and may be returned to said first dispositions with said stems retained thereon.

2. The invention claimed in claim 1 wherein said body further includes a portion upwardly of said hook portion for display of marketing information.

3. The invention claimed in claim 1 wherein each said stem is of given thickness and wherein the upward clearance between each said member and said body with said member in said first disposition is of measure less than said stem thickness.

* * * * *